US005328771A

United States Patent [19]

Mizobuchi

[11] Patent Number: 5,328,771

[45] Date of Patent: Jul. 12, 1994

[54] THERMAL FUSION TYPE DONOR FILM CAPABLE OF IMPARTING GRADATION

[75] Inventor: Yoshikazu Mizobuchi, Madison, Wis.

[73] Assignee: Minnesota Mining and Manufacturing Company, St. Paul, Minn.

[21] Appl. No.: 52,127

[22] Filed: Apr. 22, 1993

[30] Foreign Application Priority Data

May 25, 1992 [JP] Japan ..... 4-156177

[51] Int. Cl.[5] ..... B41M 5/26

[52] U.S. Cl. ..... 428/483; 428/195; 428/500; 428/522; 428/913; 428/914

[58] Field of Search ..... 428/195, 522, 480, 183, 428/500, 913, 914

[56] References Cited

U.S. PATENT DOCUMENTS 4,822,643 4/1989 Chou et al. ..... 427/256
4,839,224 6/1989 Chou et al. ..... 428/323
4,857,503 8/1989 Jongewaard et al. ..... 503/227
4,947,238 8/1990 Ishii ..... 357/71

*Primary Examiner*—Pamela R. Schwartz
*Attorney, Agent, or Firm*—Gary L. Griswold; Walter N. Kirn; Mark A. Litman

[57] ABSTRACT

A thermal fusion type donor film composed of a substratal film and a donor layer superposed on the substratal film, the donor layer comprising a terpolymer produced by polymerization of a reacting composition of 25 to 45% by weight of acrylonitrile, 35 to 55% by weight of n-butyl acrylate, and 10 to 30% by weight of 2-hydroxyethyl methacrylate (these percentages being based on the total amount of monomers) and a coloring material.

The donor film of this invention exhibit an ideal adhesiveness to a substrate of the form of a layer during the manufacture thereof, attains an efficient transfer to an image-receiving layer during the formation of an image, and imparts a gradation to the produced image, and further, is capable of bilevel printing. After the formation of the image is completed, it exhibits very low adhesiveness to other surfaces at normal room temperature.

7 Claims, 5 Drawing Sheets

THERMAL FUSION TYPE DONOR FILM CAPABLE OF IMPARTING GRADATION

DETAILED DESCRIPTION OF THE INVENTION

1. Field of Use

This invention relates to a thermal fusion type (thermal mass transfer) donor film capable of imparting gradation.

2. Prior Art

The thermal fusion type (also known as thermal mass transfer) image forming system is inexpensive and has a long service life because it is capable of producing a color image with a low thermal energy, compared with the thermal dye diffusion type image forming system. The two systems have widely different image quality because the thermal fusion type image forming system has difficulty in imparting gradation to an image.

In recent years, efforts have been directed toward furnishing the thermal fusion type image forming systems with an improved capacity for gradation without a sacrifice of the aforementioned merits inherent therein, to thereby enable this system to produce an image having a quality closely approximating that obtained by the thermal dye diffusion type system.

Japanese Unexamined Patent Publication No. 72,996/1990 discloses the idea of incorporating fine powder into a donor layer. In this case, when the donor layer is heated with the thermal energy from a thermal head, the donor material (synthetic or natural wax) is melted and the molten donor material is caused by a capillary action through empty spaces formed by powder particles to migrate from the donor layer into an image-receiving layer depending on the added heat energy and give rise therein to a graduated image. In this donor construction, however, the donor layer itself is complicated and is required to have a fairly large thickness, compared with a uniform donor layer. Further, the donor of this sort is unfit for the formation of a high density image because the powder is allowed to migrate from the donor layer into the image-receiving layer during the thermal fusion transfer.

Japanese Unexamined Patent Publication No. 117,792/1987 discloses the incorporating of a finely reticulated texture in a donor layer, to thereby impart a gradation to an image. This incorporation complicates the donor layer.

Japanese Unexamined Patent Publication No. 26,596/1991 discloses the idea of imparting a gradation to a printed image by the formation of irregular islands of the donor layer on a substrate.

Japanese Unexamined Patent Publication No. 139,290/1990 discloses a method of effecting an impartation of gradation to an image by the use of a plurality of polymer materials possessing different melting points or by the combined use of a polymer material with natural wax. This method, however, fails to impart a smooth gradation to an image.

SUMMARY OF THE INVENTION

This invention provides a thermal fusion type donor film which possesses a very simple construction composed of a substratal film and a donor layer, and imparts gradation to an image.

The object described above is accomplished by a thermal fusion type donor film composed of a film substrate and a donor layer superposed on the film substrate, the donor layer comprising a polymer produced by polymerization of a reacting composition of 25 to 45% by weight of acrylonitrile, 35 to 55% by weight of n-butyl acrylate, and 10 to 30% by weight of 2-hydroxyethyl methacrylate (these percentages beings based on the total amount of monomers) and a coloring material.

DETAILED DESCRIPTION OF THE INVENTION

Figure 1:
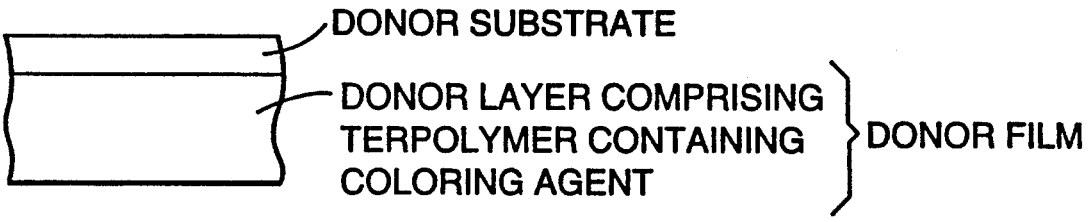
FIG. 1 is a cross section schematically illustrating the construction of a donor film of this invention.

The thermal fusion type donor film of this invention comprises a film substrate and a donor layer superposed on the film substrate. The materials effectively useable for the film substrate include polyethylene terephthalate (PET), polyethylene naphthalate, polyimide, nylon, and the like. Among other material mentioned above, PET is particularly desirable. The thickness of the substratal film is from 10 μm to 2.5 μm, preferably from 6 μm to 3.5 μm.

The donor layer of this invention is composed of a coloring material and a polymer material. The coloring material is not an essential characteristic of this invention, and may be any of the coloring materials generally adopted for the thermal fusion type donor film. Such pigments as cyan, magenta, red, green, blue, black and yellow are available, for example. Other pigments such as white, opaque, black, fluorescent and metallic pigments may alternatively be used.

The polymer material is a polymer (e.g., terpolymer) synthesized from acrylonitrile, n-butyl acrylate, and 2-hydroxyethyl methacrylate. It is suspected that acrylonitrile imparts rigidity, n-butyl acrylate adhesiveness, and 2-hydroxyethyl methacrylate softness to the film. The amount of acrylonitrile is from 25 to 45% by weight, preferably from 25 to 35% by weight, based on the total amount of monomers. If the amount of acrylonitrile is higher than this range, the polymer material is rigid and insoluble in ordinary polar organic solvents which have low boiling points. If the amount is significantly lower, the polymer material exhibits unduly high adhesiveness at normal room temperature.

The amount of n-butyl acrylate is from 35 to 55% by weight, preferably from 40 to 55% by weight, based on the total amount of monomers. If the amount of n-butyl acrylate is too high, the polymer material exhibits unduly high adhesiveness at normal room temperature. If this amount is too small, the donor layer has a poor adhesiveness to the image-receiving layer during the thermal transfer. The amount of 2-hydroxyethyl methacrylate is from 10 to 30% by weight, preferably from 15 to 30% by weight, based on the total amount of monomers. If the amount of 2-hydroxyethyl methacrylate is greater than this range, the polymer material loses physical strength.

The copolymerization of these monomers is carried out in a nonpolar solvent such as, for example, toluene, xylene, or benzene in the presence of a reaction initiator, i.e., a radical-generating agent such as 2,2'-azobis-(isobutylonitrile), 2,2'-axobis(2,4-dimethylvaleronitrile), or dibenzoyl peroxide at a temperature of from 40° C. to 80° C., preferably from 50° C. to 65° C. After this reaction is completed, the polymer can be recovered by mixing the polymerization reaction mixture with a liquid such as, for example, ethanol, isopropyl alcohol, or methanol which is capable of dissolving the solvent and the monomers involved in the polymerization and incapable of dissolving the produced polymer thereby inducing sedimentation of the polymer.

The formation of the donor layer is accomplished simply by causing the polymer and a coloring material to be separately dissolved or dispersed in a solvent such as, for example, tetrahydrofuran, methylethyl ketone, or acetone, mixing the resultant solutions or dispersions, applying the resultant mixture to the film substrate as generally practiced, and drying the applied layer of the mixture. The application mentioned above can be performed by any coating devices in popular use such as, for example, bar coater, knife coater, extrusion coater, curtain coater, or die coater. The weight ratio of the macromolecular material to the coloring material is from 9:1: to 3:7, preferably from 4:1 to 2:3. The thickness of the donor layer after drying is from 1 to 10 μm, preferably from 2 to 5 μm. The drying of the donor layer is carried out at a temperature of from 40° C. to 80° C., preferably from 60° C. to 70° C.

Figure 2:
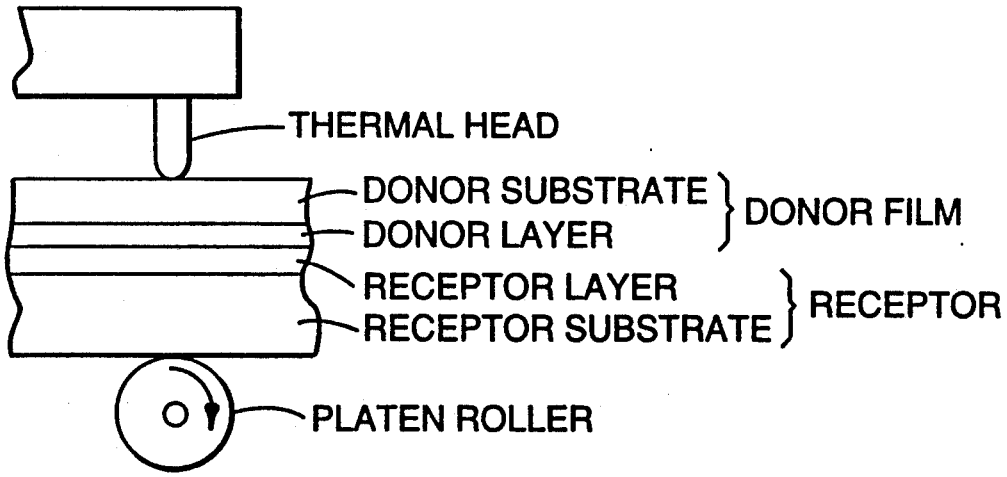
FIG. 2 is a diagram schematically illustrating the state of use of the donor film of this invention.

The construction of the donor film of this invention is schematically illustrated in FIG. 1. One example of the use of the donor film of this invention is schematically illustrated in FIG. 2. The donor film is superposed on an image-receiving member in such a manner that the donor layer of the donor film contacts the image-receiving layer of the image-receiving member. The donor film thus superposed is moved past the space intervening between a platen roller and a thermal head. When thermal energy, varied over time, is transferred from the thermal head to the donor film, the part of the donor layer containing the coloring material is melted proportionately to the existent magnitude of energy and transferred onto the image-receiving layer. As a result, a color having density proportionate to the thermal energy is printed on the image-receiving layer.

This invention provides a thermal fusion type donor film of simple construction formed of two layers. This donor film imparts gradation to an image and allows a bilevel printing. After the formation of the image, the donor film exhibits a very low adhesiveness to other surfaces at a room temperature.

EXAMPLES

Now, this invention will be described more specifically below with reference to working examples.

I) Preparation of Donor Film

Copolymers of four different combinations (#1, #2, #3, and #4) indicated in the following Table 1 below were synthesized.

TABLE 1

| Components of composition | #1 | #2 | #3 | #4 |
|---|---|---|---|---|
| Acrylonitrile | 10.0 g | 10.0 g | 7.5 g | 10.0 g |
| n-Butyl acrylate | 15.0 g | 15.0 g | 10.8 g | 20.0 g |
| 2-Hydroxyethyl methacrylate | 10.0 g | 5.0 g | 6.0 g | 10.0 g |
| Toluene | 40 g | 40 g | 45 g | 40 g |
| AIBN | 0.1 g | 0.1 g | 0.1 g | 0.1 g |

AIBN: 2,2'-Azobis(isobutyronitrile)

Specifically, the components of each combination shown in Table 1 were mixed in a pressure bottle having an inner volume of 100 ml, de-oxygenized by the use of nitrogen gas for about 10 minutes, tightly sealed, and retained in a rotary constant temperature bath (produced by Taiyo Kagaku Kogyo K. K.) kept at 55° C. for about 65 hours. After the reaction was completed, the reaction solution was poured into ethanol to induce sedimentation of the produced copolymer and allow a recovery thereof. This copolymer was re-dissolved in tetrahydrofuran and then re-precipitated in ethanol to effect a removal of the unaltered monomers. The copolymer thus obtained was dried in a vacuum drier at 60° C. for about three hours, to obtain the polymer for the donor.

The copolymer mentioned above and a coloring material were separately dissolved or dispersed in a concentration of 5% by weight in tetrahydrofuran. The produced solutions or dispersions of an equal weight were mixed. The resultant mixture was applied on a PET film (3.5 μm and 6 μm in thickness) with the aid of a Mayer bar #10. The thickness of the donor layer in the produced donor film was approximately from 2 to 4 pn.

As coloring materials, cyan, magenta, and yellow (produced by Sun chemical Corp. of the USA and marketed under the trademark designations respectively of "Sunfast Blue 15:3," "Lithol Rubine 2190026,11 and "Sun Diarylide Yellow") were used. These were pigments.

II) Method for Evaluation of Image Printing Conditions of Thermal Printer

For the evaluation of gradation of a printed image, printing was performed in 8 stages and 16 stages by the use of a printer provided with a thermal head capable of 200 dpi in 13.4 cm of width (produced by 3M Corp. of the USA and marketed under product code "GRL"), with the voltage to the thermal head varied. Table 2 shows the data on burn time and thermal energy obtained in the test. During the printing, a load of 1.9 kg was applied to the thermal head.

TABLE 2

Relationship between burn time (m.seconds) for image formation and thermal energy (J/cm 2

| Stage | Burn time (m.seconds) | Thermal energy (J/cm$^2$) 8.00 volts | 9.50 volts | 10.00 volts |
|---|---|---|---|---|
| 1 | 0.28 | 0.12 | 0.17 | 0.18 |
| 2 | 0.56 | 0.24 | 0.34 | 0.37 |
| 3 | 0.84 | 0.36 | 0.51 | 0.56 |
| 4 | 1.12 | 0.48 | 0.68 | 0.75 |
| 5 | 1.40 | 0.60 | 0.85 | 0.94 |
| 6 | 1.68 | 0.72 | 1.02 | 1.13 |
| 7 | 1.96 | 0.84 | 1.19 | 1.31 |

TABLE 2-continued

| Relationship between burn time (m.seconds) for image formation and thermal energy (J/cm 2 | | | | |
|---|---|---|---|---|
| | Burn time | Thermal energy (J/cm$^2$) | | |
| Stage | (m.seconds) | 8.00 volts | 9.50 volts | 10.00 volts |
| 8 | 2.24 | 0.96 | 1.36 | 1.50 |
| 9 | 2.52 | 1.08 | 1.53 | 1.69 |
| 10 | 2.80 | 1.20 | 1.70 | 1.88 |
| 11 | 3.08 | 1.32 | 1.87 | 2.07 |
| 12 | 3.36 | 1.44 | 2.04 | 2.26 |
| 13 | 3.64 | 1.56 | 2.21 | 2.45 |
| 14 | 3.92 | 1.68 | 2.38 | 2.63 |
| 15 | 4.20 | 1.80 | 2.55 | 2.82 |
| 16 | 4.48 | 1.93 | 2.72 | 3.01 |

For the evaluation of an image on the bilevel, a printer provided with a thermal head of 3 cm in width rated in 100 dip (produced by 3M Corp. of the USA and marketed under product code "GRL") was used, with the applied voltage set at 7 volts and the burn time at 6.4 m.sec. The thermal energy applied thereby was 2.08 J/cm$^2$. During the printing, a load of 1.9 kg was applied to the thermal head.

Image-Receiving Member

As an image-receiving member, an overhead projection (OHP) quality film (produced by Visual Systems Division, 3M Corp. of the USA and marketed under product code "T0641) was used.

Evaluation of Image Density

For the measurement of the optical transmission density of a printed image, an image density meter (Macbeth TR924) was used. A filter of A type was used for this measurement.

III) Evaluation of Images Obtained in Examples 1 to 6 and Comparative Example

EXAMPLE 1

Printed images produced with image data outputs of 8 stages and 16 stages under application of 10.00 volts from two magenta donor films containing in their donor layers the polymer, #1, produced by the method described in I) preparation of donor film above were evaluated as to gradation.

Figure 3:
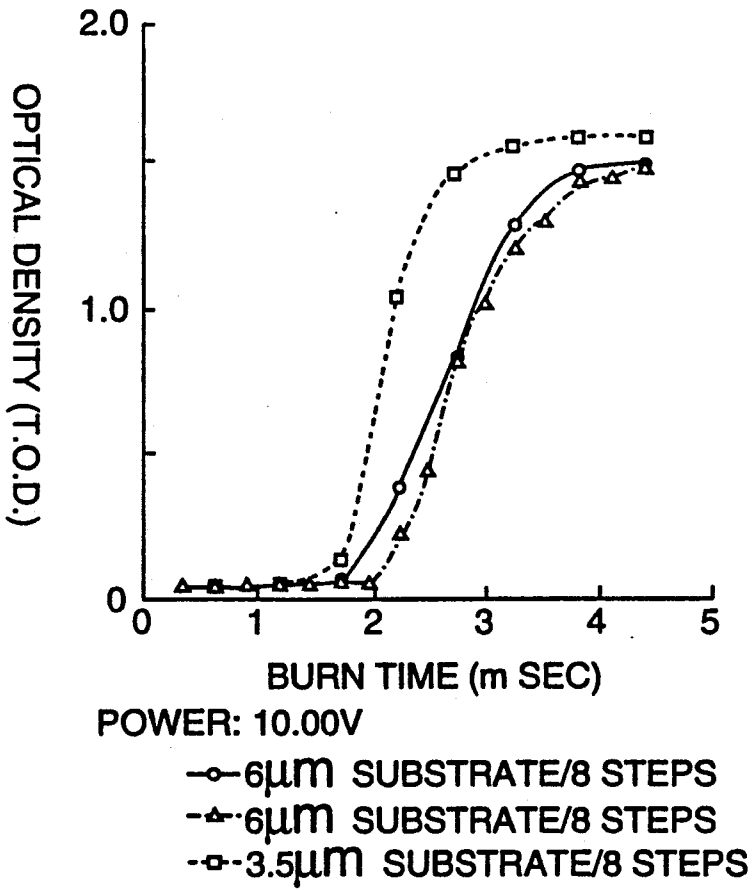
FIG. 3 is a graph showing the results of evaluation of a donor film of Example 1 as to gradation.

The donor film possessing a substrate 6 μm in thickness as illustrated in FIG. 3 exhibited ample gradation. Virtually no difference was recognized between the image data outputs of 8 stages and 16 stages.

EXAMPLE 2

Figure 4:
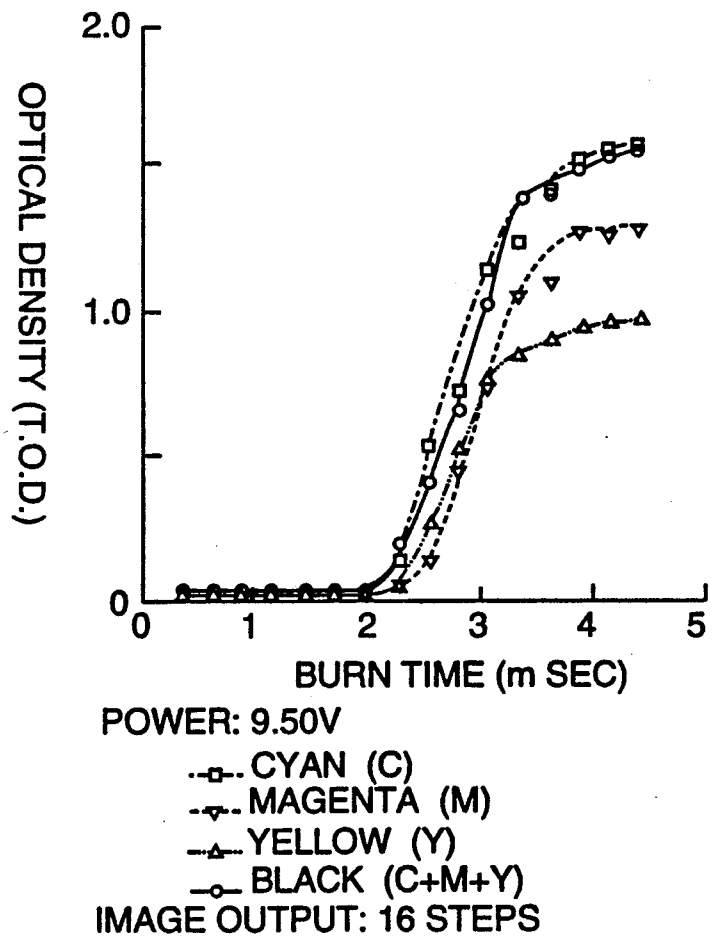
FIG. 4 is a graph showing the results of evaluation of a donor film of Example 2 as to gradation.

Printed images produced with an image data output of 16 stages under application of 9.50 volts from three donor films (colored in cyan, magenta, and yellow) containing the polymer, #1, in the respective donor layers on a substrate 6 microns in thickness were evaluated as to gradation, and showed capacities for gradation as illustrated in FIG. 4. Black images produced by superposed printing of images of cyan, magenta, and yellow colors in the order mentioned acquired ample capacities for gradation.

EXAMPLE 3

Figure 5:
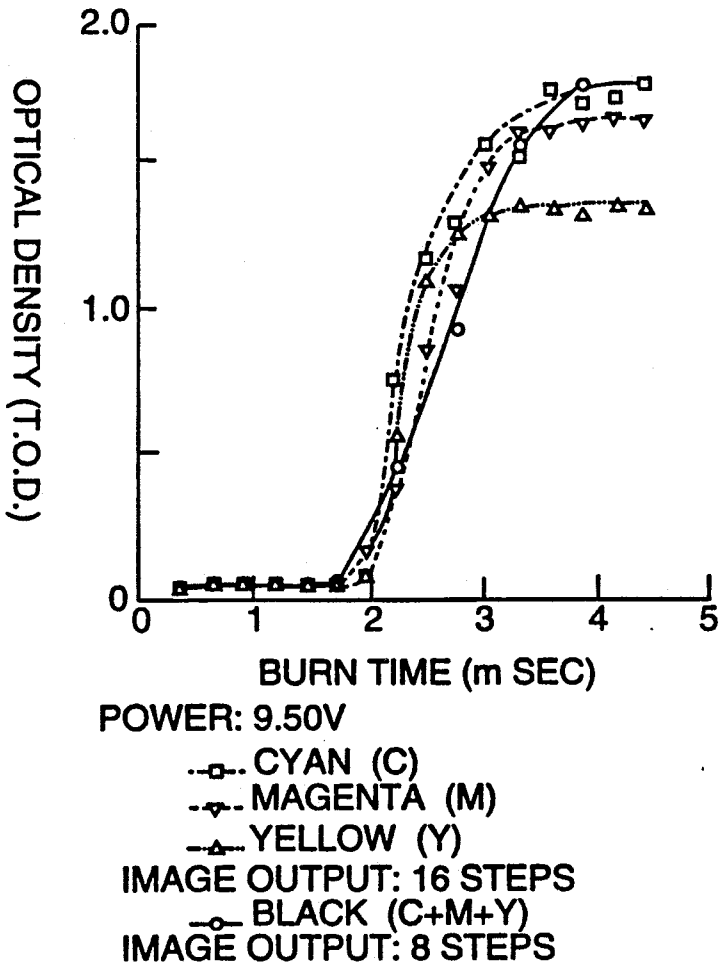
FIG. 5 is a graph showing the results of evaluation of a donor film of Example 3 as to gradation.

Printed images produced with an image data output of 16 stages under application of 9.50 volts from three donor films (colored in cyan, magenta, and yellow) containing the polymer, #2, in their respective donor layers on a substrate 3.5 microns in thickness were evaluated as to gradation and showed capacities for gradation as illustrated in FIG. 5. Black images produced by superposed printing of images of cyan, magenta, and yellow colors in the order mentioned acquired ample capacities for gradation, though the image data outputs were in 8 stages.

EXAMPLE 4

Figure 6:
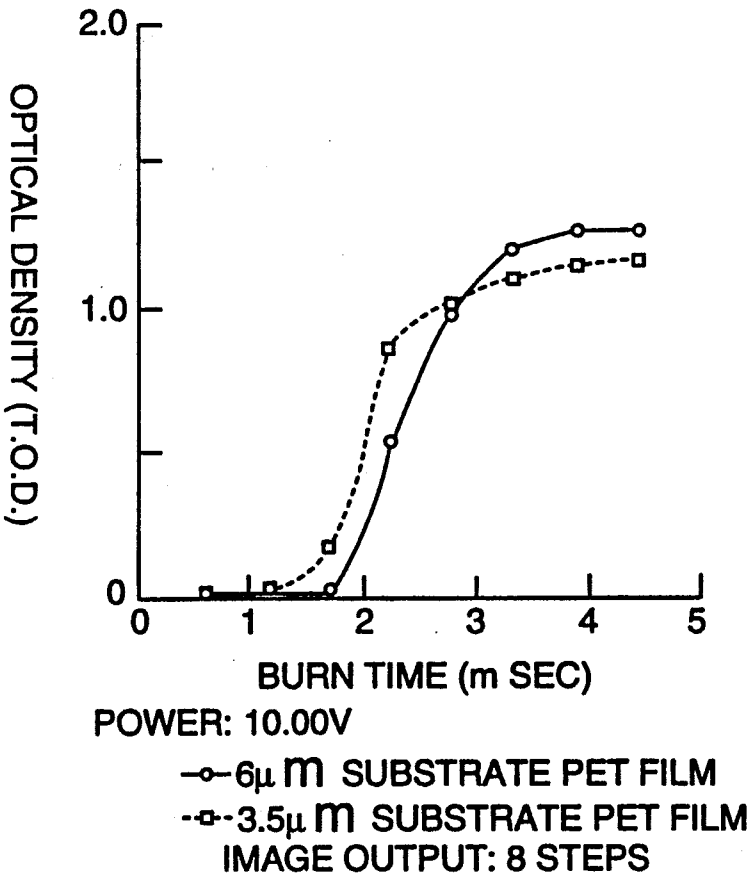
FIG. 6 is a graph showing the results of evaluation of a donor film of Example 4 as to gradation

Printed images produced with an image data output of 8 stages under application of 10.00 volts from two magenta donor films containing the polymer #3, in the respective donor layers were evaluated as to gradation. As illustrated in FIG. 6, though a difference by the thickness of the donor substrate was recognized the printed images from the donor films using a substrate 6 microns in thickness acquired gradation.

EXAMPLE 5

Figure 7:
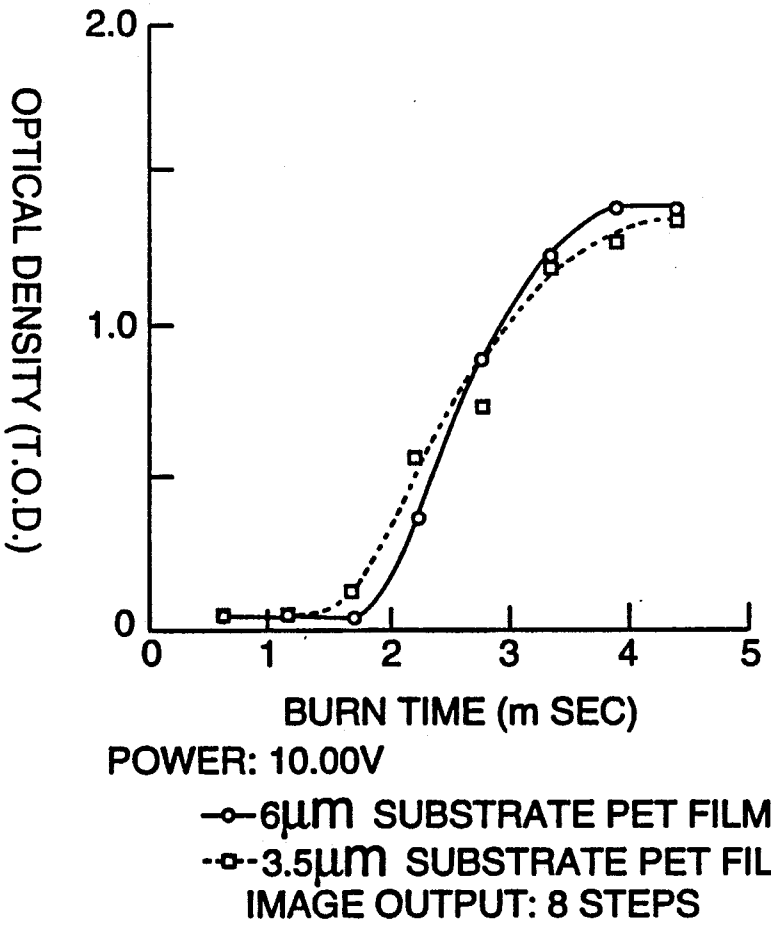
FIG. 7 is a graph showing the results of evaluation of a donor film of Comparative Experiment as to gradation.

Printed images produced by the same method as in Example 4 from two magenta donor films containing the polymer, #4, in the respective donor layers were evaluated as to gradation. These printed images acquired ample gradation as illustrated in FIG. 7. Virtually no difference by the thickness of donor substrate was recognized.

EXAMPLE 6

Figure 9:
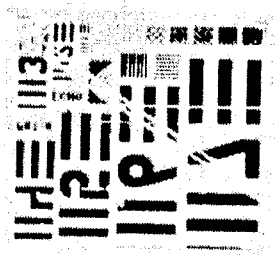
FIG. 9 is a photograph depicting on behalf of a drawing the possibility of a donor film of Example 6 being used for bilevel printing.
Figure 10:
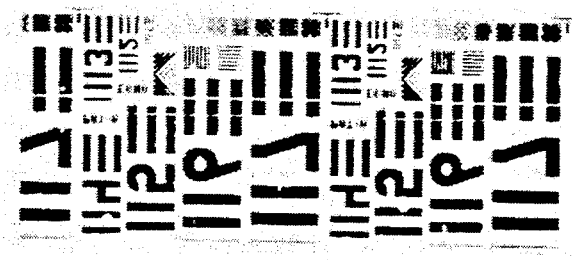
FIG. 10 is a photograph depicting on behalf of a drawing the possibility of a donor film of Example 6 being used for bilevel printing.

Images were produced by the bilevel printing method using cyan donor films containing the polymer, #2, in the donor layers and magenta donor films containing the polymer, #4, in the donor layers on a substrate 3.5 microns in thickness. The results are shown in FIG. 9 and FIG. 10. It is clearly noted from these results that these polymer materials are acceptable for the bilevel recording.

COMPARATIVE EXAMPLE

Figure 8:
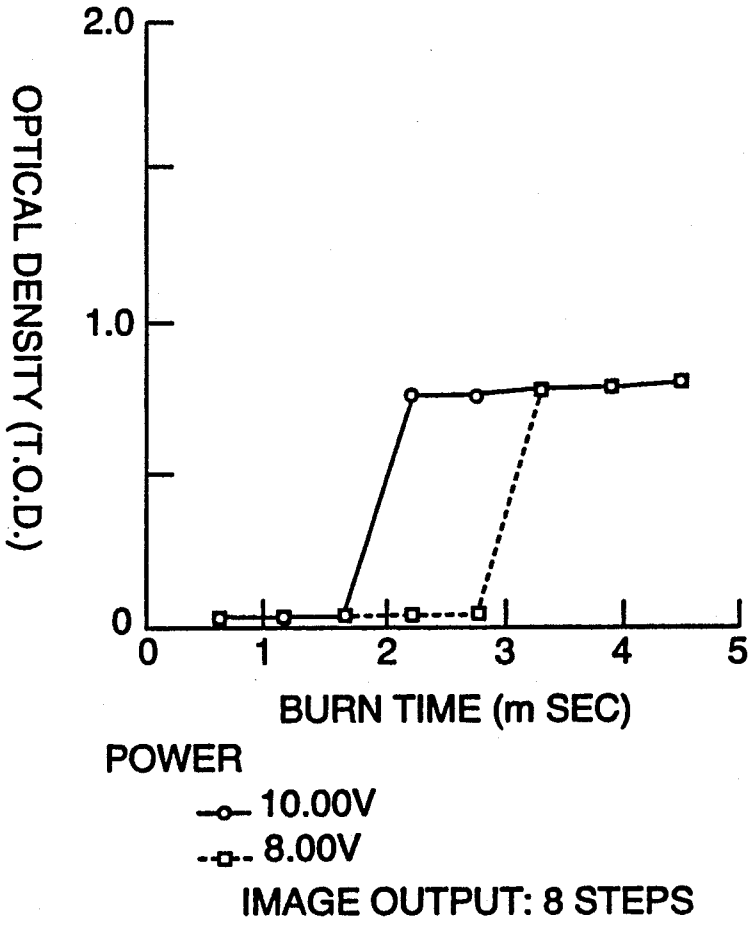
FIG. 8 is a graph showing the result of evaluation of a donor film of Example 5 as to gradation.

Images were produced from magenta donor films containing conventional wax (melting point 68° C.) in the donor layers. Even when the voltage applied was varied in two magnitudes (10.00 volts and 8.00 volts), the images showed no discernible gradation because the thermal fusion of the donor films were sharp as illustrated in FIG. 8.

I claim:

1. A thermal donor film comprising a film substrate and a donor layer on said film substrate, said donor layer comprising a terpolymer produced by polymerization of a reactive composition of 25 to 45% by weight of acrylonitrile, 35 to 55% by weight of n-butyl acrylate, and 10 to 30% by weight of 2-hydroxyethyl methacrylate, and a coloring material.

2. The donor film of claim 1 wherein said coloring material comprises a dye.

3. The donor film of claim 1 wherein said coloring material comprises a pigment.

4. The donor film of claim 3 wherein said pigment has a color selected from the group consisting of cyan, magenta, yellow, red, green, blue, white and black.

5. The donor film of claim 1 wherein said substrate comprises polyester.

6. The donor film of claim 5 wherein said polyester comprises polyethyleneterephthalate.

7. The donor film of claim 1 wherein said n-butyl acrylate comprises 40–55% by weight of monomers in said composition.

* * * * *

UNITED STATES PATENT AND TRADEMARK OFFICE

CERTIFICATE OF CORRECTION

PATENT NO. : 5,328,771

DATED : July 12, 1994

INVENTOR(S) : Mizobuchi

It is certified that error appears in the above-indentified patent and that said Letters Patent is hereby corrected as shown below:

Column 2, line 5, delete "beings" and insert --being--.

Column 4, line 41, delete "chemical" and insert --Chemical--.

Column 5, line 17, delete "dip" and insert --dpi--.

Column 6, line 46, after the word "thermal" and before the word "donor", insert --mass transfer--.

Signed and Sealed this

Eighteenth Day of October, 1994

*Attest:*

*Attesting Officer*

BRUCE LEHMAN

*Commissioner of Patents and Trademarks*